US011614099B2

(12) United States Patent
Lerner et al.

(10) Patent No.: US 11,614,099 B2
(45) Date of Patent: Mar. 28, 2023

(54) MULTIPORT PUMPS WITH MULTI-FUNCTIONAL FLOW PATHS

(71) Applicant: AOI (Advanced Oilfield Innovations, Inc, Stafford, TX (US)

(72) Inventors: Daniel Maurice Lerner, Missouri City, TX (US); Andre Orban, Sugarland, TX (US)

(73) Assignee: AOI (Advanced Oilfield Innovations, Inc.), Stafford, TX (US)

( * ) Notice: Subject to any disclaimer, the term of this patent is extended or adjusted under 35 U.S.C. 154(b) by 859 days.

(21) Appl. No.: 16/507,401

(22) Filed: Jul. 10, 2019

(65) Prior Publication Data

US 2020/0158142 A1 May 21, 2020

Related U.S. Application Data

(63) Continuation of application No. 16/198,135, filed on Nov. 21, 2018, now Pat. No. 10,871,174, which is a (Continued)

(51) Int. Cl.
*F04B 27/08* (2006.01)
*F04B 11/00* (2006.01)

(Continued)

(52) U.S. Cl.
CPC ..... *F15B 7/10* (2013.01); *F03C 1/06* (2013.01); *F04B 1/12* (2013.01); *F04B 23/021* (2013.01);

(Continued)

(58) Field of Classification Search
CPC .... F04B 11/00; F04B 23/021; F04B 27/0465; F04B 27/0839
See application file for complete search history.

(56) References Cited

U.S. PATENT DOCUMENTS 3,163,791 A 12/1964 Carlson
3,435,614 A 4/1969 Ledeen et al.

(Continued)

FOREIGN PATENT DOCUMENTS

CN 2865216 2/2007
CN 102887432 A 1/2013

(Continued)

OTHER PUBLICATIONS

International Search Report for PCT/US2019/056208 dated Jan. 30, 2020.

(Continued)

*Primary Examiner* — Michael Leslie
(74) *Attorney, Agent, or Firm* — ePatentManager.com; Guerry L. Grune

(57) ABSTRACT

Multiport pumps and associated pumping systems are described that provide a selective hydraulic or electrically powered pump/pump system. The pumps provide movement within a device or larger system. Movement can cause compression/expansion of a fluid and provide fluid movement within the same device or system. In this instance, the volume of fluid and the fluid flow path within, from, and to the pump(s) is kept constant to reduce or eliminate cavitation, seizure, and/or hydraulic lock. Use of at least one reservoir comprising; a compensator tank, a port allowing for operation at ambient pressure, and a pressure measuring device measuring pressure allowing for unbalanced flow to and from the multiport pumps along with thermal expansion or compression is detailed. In addition, use of a multiport swashplate pumps and associated valve plates that incorporate the features and functions of several valves not heretofore provided within the pump itself is also described.

17 Claims, 3 Drawing Sheets

Related U.S. Application Data continuation-in-part of application No. 15/331,343, filed on Oct. 21, 2016, now Pat. No. 10,598,193.

(60) Provisional application No. 62/245,510, filed on Oct. 23, 2015.

(51) Int. Cl.

| | |
|---|---|
| ***F15B 7/10*** | (2006.01) |
| ***F15B 1/26*** | (2006.01) |
| ***F04B 27/18*** | (2006.01) |
| ***F15B 15/17*** | (2006.01) |
| ***F15B 19/00*** | (2006.01) |
| ***F04B 1/12*** | (2020.01) |
| ***F03C 1/06*** | (2006.01) |
| ***F04B 23/02*** | (2006.01) |
| ***F04B 49/22*** | (2006.01) |
| *F04B 41/02* | (2006.01) |

(52) U.S. Cl.

CPC ..... *F04B 27/0839* (2013.01); *F04B 27/1804* (2013.01); *F04B 49/22* (2013.01); *F15B 1/26* (2013.01); *F15B 15/17* (2013.01); *F15B 19/005* (2013.01); *F04B 11/00* (2013.01); *F04B 41/02* (2013.01)

(56) References Cited

U.S. PATENT DOCUMENTS

| | | | | |
|---|---|---|---|---|
| 3,627,451 | A * | 12/1971 | Kouns | F01B 3/0055 417/271 |
| 4,007,663 | A | 2/1977 | Nagamoto et al. | |
| 4,077,746 | A * | 3/1978 | Reynolds | F15B 3/00 417/225 |
| 5,144,801 | A * | 9/1992 | Scanderbeg | F15B 15/18 60/475 |
| 5,247,869 | A | 9/1993 | Palmberg et al. | |
| 5,473,939 | A | 12/1995 | Leder et al. | |
| 5,536,150 | A | 7/1996 | Tucker | |
| 5,556,263 | A | 9/1996 | Jacobsen et al. | |
| 5,587,525 | A | 12/1996 | Shwe et al. | |
| 5,603,354 | A | 2/1997 | Jacobsen et al. | |
| 5,618,163 | A | 4/1997 | Jacobsen et al. | |
| 5,635,631 | A | 6/1997 | Yesudas et al. | |
| 5,647,575 | A | 7/1997 | Jacobsen et al. | |
| 5,710,401 | A | 1/1998 | Jacobsen et al. | |
| 5,799,690 | A | 9/1998 | Jacobsen et al. | |
| 5,807,075 | A | 9/1998 | Jacobsen et al. | |
| 5,913,647 | A | 8/1999 | Jacobsen et al. | |
| 5,941,533 | A | 8/1999 | Jacobsen et al. | |
| 5,944,495 | A | 8/1999 | Jacobsen et al. | |
| 6,007,310 | A | 12/1999 | Jacobsen et al. | |
| 6,116,138 | A * | 9/2000 | Achten | F04B 1/2042 91/472 |
| 6,854,268 | B2 * | 2/2005 | Fales | F15B 21/14 91/454 |
| 6,863,502 | B2 | 3/2005 | Bishop et al. | |
| 6,874,343 | B1 | 4/2005 | Ariji | |
| 6,886,331 | B2 | 5/2005 | Joshi | |
| 6,921,849 | B2 * | 7/2005 | Amasino | C12N 9/0071 536/23.6 |
| 7,934,413 | B2 | 5/2011 | Winchester | |
| 8,096,117 | B2 | 1/2012 | Ingersoll et al. | |
| 8,161,741 | B2 | 4/2012 | Ingersoll et al. | |
| 8,196,664 | B2 | 6/2012 | Reid | |
| 8,286,659 | B2 | 10/2012 | Ingersoll et al. | |
| 8,359,857 | B2 | 1/2013 | Ingersoll et al. | |
| 8,511,390 | B2 | 8/2013 | Coyle et al. | |
| 8,522,538 | B2 | 9/2013 | Ingersoll et al. | |
| 8,522,886 | B2 | 9/2013 | Christie et al. | |
| 8,544,264 | B2 * | 10/2013 | Anderson | E02F 9/2217 60/475 |
| 8,602,112 | B2 | 12/2013 | Reid | |
| 8,925,637 | B2 | 1/2015 | Coyle et al. | |
| 9,695,841 | B2 * | 7/2017 | Udagawa | E02F 9/2235 |
| 10,871,174 | B2 * | 12/2020 | Lerner | F04B 27/0839 |
| 2011/0225962 | A1 | 9/2011 | Landrum | |
| 2011/0319221 | A1 | 12/2011 | O'Brien et al. | |
| 2013/0139900 | A1 | 6/2013 | Lewis | |
| 2014/0190152 | A1 | 7/2014 | Ingersoll et al. | |
| 2014/0318113 | A1 | 10/2014 | Harsia et al. | |
| 2015/0060055 | A1 | 3/2015 | Tolman et al. | |

FOREIGN PATENT DOCUMENTS

| | | | |
|---|---|---|---|
| CN | 203532369 | | 4/2014 |
| CN | 103817969 | A | 5/2014 |
| CN | 107035645 | | 8/2017 |
| DE | 4396844 | T1 | 11/1995 |
| DE | 19541220 | C1 | 3/1997 |
| DE | 19706116 | A1 | 8/1998 |
| DE | 102008062483 | A1 | 6/2017 |
| GB | 1098982 | A | 1/1968 |
| GR | 20050100396 | A | 1/2007 |
| KR | 101052296 | B1 | 7/2011 |
| RU | 2044930 | C1 | 9/1995 |
| RU | 2182676 | C1 | 5/2002 |
| RU | 2290538 | C1 | 12/2006 |
| RU | 2593325 | C1 | 8/2016 |
| WO | 9940318 | A1 | 8/1999 |
| WO | 0177529 | A2 | 10/2001 |

OTHER PUBLICATIONS

Written Opinion of the International Searching Authority for PCT/US2019/056208 dated Jan. 30, 2020.

* cited by examiner

MULTIPORT PUMPS WITH MULTI-FUNCTIONAL FLOW PATHS

PRIORITY

This application is a continuation of and claims priority under 35 USC § 120 of U.S. patent application Ser. No. 16/198,135 filed Nov. 21, 2018, entitled "Prime Mover System and Methods Utilizing Balanced Flow Within Bi-Directional Power Units", which is a continuation-in-part of U.S. patent application Ser. No. 15/331,343 filed Oct. 21, 2018, of the same title, which is a non-provisional conversion of and claims priority under 35 USC § 119 from Provisional Application 62/245,510 filed Oct. 23, 2015 and entitled "Prime Mover System and Methods Utilizing Bi-Directional Power Units", the entire contents of which are hereby incorporated by reference.

BACKGROUND OF THE INVENTION

Multiport pumps are seldom known or used in either the literature or in industry. In contrast, swash plate pumps have been known and used for many decades since at least the 1940s. Pumps of this type considerably vary in structure, but are all similar in that they operate reciprocating pistons from a rotary power input shaft using a swash plate or ring driven by a tilted crank associated with the power input shaft. Many such variations have focused on the design of the swashplate or the tilted crank or both. Although the use of a swash plate pump, as above described, has been commonly known and used in the past, the need to provide a multiport pump and swashplate combination which can maintain the volume of fluid within the pump and also keep the volume of fluid flow into and out of a designated fluid reservoir has not been previously established. Another serious drawback to swash plate pump structures is the presence of relatively large unbalanced forces found within these designs. The present multiport pump designs address these deficiencies and provide pumps less likely to cavitate or exhibit hydraulic lock, and/or seizure, thereby improving the efficiency and lowering costs associated with excessive valving and maintenance. These pumps and associated systems are particularly valuable for downhole oil and gas exploration but may also be used in automotive, aerospace, locomotive and other industrial applications.

Moreover, it is an object of the present disclosure to provide a multiport pumps and more specifically multiport swashplate pumps capable of providing a balanced and constant fluid volume and fluid flow into and out of the pump. The design for the swashplate pumps was determined to be possible by adjustments to the number of ports associated with the kidney shaped through-bores of the valve plates used in constructing these pumps.

The present disclosure describes these multiport valve plates utilized to create the constant or near constant volumetric fluid flow into and out of the pump as well maintaining a constant or near volume of fluid within the pump itself. In order for this pump to operate properly and efficiently, a reservoir that compensates for the flow of fluid into or out of the pump as needed must be included in the overall unit. These pumps can be immersed in the fluid or within the fluid reservoir or both. The reservoir can be accessed by the pump so that fluid will fill or deplete the fluid within, or flowing into or out of the pump, as required, to keep the volume and associated volumetric flow along a flow path constant. By accomplishing constant volume and associated volumetric flow, the swashplate pump will operate so that cavitation, seizure, and hydraulic lock are reduced and in many cases, eliminated. This will lead to increased efficiency, improved reliability, and greatly reduced costs associated with the repair and replacement of improperly functioning pumps.

Still further objects and features of the present disclosure will at once become apparent to those skilled in the art from a consideration of the specification and attached drawings herein.

Although the pumps described herein in detail have been designed specifically for downhole petrochemical well applications, the assemblies and associated valve operation and engagement with actuated hydraulic cylinders and pistons pose opportunities for optimizing the actuation and efficiencies in other applications. These applications include other technology fields involving; energy generation, distribution, and storage, including cogeneration, hydraulic power systems, air and water reclamation systems, as well as transportation systems including civilian and military automobiles, aircraft, and ships. Here, the hydraulic fluids can be air, gas, or liquid.

SUMMARY OF THE INVENTION

Systems, methods, and devices for optimizing bi-directional movement of (mostly) mechanical devices including pistons, motors, pumps, gears, valves, packers, as well as other mechanical devices that require automated movement as required using compression and/or expansion of fluids such as air, gas or hydraulic fluids are described herein. The pumps described herein can be powered by hydraulic power, electrical power, or a combination of both.

More specifically, The disclosure provides for at least one multiport pump that pumps fluid in either a single or bi-directional direction having multiple ports comprising; at least one inlet port, at least one outlet port, and at least one equilibrator port connected to a fluid reservoir wherein the equilibrator port equilibrates inlet and outlet flow such that a combination of the inlet port and the equilibrator port provide just enough fluid volume to fill one or more cavities of the pump so that fluid escapes through the outlet port to ensure overfill of the ports is prevented and so that a balanced equilibrium constant volume of fluid is maintained and resides within the pump during operation, wherein the multiport pump withdraws and/or sends fluid into and out of the fluid reservoir to maintain a constant volume of fluid that reduces cavitation and hydraulic fluid lock and also provides and allows a balanced constant continuous fluid flow along a fluid flow path that contains fluid that flows in either a clockwise or counterclockwise direction into and out of the fluid reservoir that also acts as a constant volume compensator, such that an incremental volume of fluid is added or removed to maintain equal symmetric inflow and outflow of fluid into and out of the multiport pump.

In this case the one or more multiport pumps are selected from the group consisting of;

swashplate pumps, reciprocating pumps, scroll pumps, piston pumps, positive displacement pumps, diaphragm pumps, injection pumps, centrifugal pumps, gear pumps, and metering pumps and wherein the fluid is air, gas, a liquid, or any combination of air, gas, and liquid.

The balance of both the volume of fluid and the fluid flow may also occur simultaneously during operation of the pump.

Here the one or more pumps are a multiport swashplate pump that includes a multi-port valve plate such that fluid flow into and out of the swashplate pump and is either unidirectional or bidirectional and wherein the multi-port valve plate includes at least three ports.

In at least one embodiment, the at least three-port valve plate ensures balanced fluid flow exists and is maintained within the pump in that the fluid flow volume remains constant throughout operation of the swashplate pump as the pump is utilized to operate and control movement of an hydraulic apparatus.

The at least three-port valve plate includes at least three corresponding valves wherein at least one port is designated for counterclockwise flow, at least one port is designated for clockwise flow and at least one port is designated as a reservoir port, wherein said reservoir port allows for fluid flow balancing by utilizing the reservoir to either add or remove a volume of fluid as needed during operation of the swashplate pump.

In another embodiment, the swashplate pump includes an at least four-port valve plate and includes at least four corresponding valves wherein at least one port is designated for counterclockwise flow, at least one port is designated for clockwise flow, at least one port is designated as a reservoir port, and at least one port is designated as a sensor port.

Here, the sensor port provides a portion of the pump for including a sensor within or attached to the port that measures volume, pressure, temperature and additional fluid flow parameters of both fluid and fluid flow along a fluid flow path.

In some cases, the sensor port functions simply a monitor port, wherein the monitor port monitors fluid, fluid volume and fluid flow and can also provide hydraulic actuators.

In another embodiment, the pump moves in a clockwise direction it delivers fluid to a clockwise port and withdraw fluid from a counterclockwise port. Also, the pump can move in a counterclockwise direction and deliver fluid to a counterclockwise port and withdraw fluid from a clockwise port.

In yet another embodiment, the three-port valve plate with the swashplate pump is immersed in at least one reservoir.

Also, the at least four-port valve plate with the swashplate pump are immersed in at least one reservoir.

The pump and/or said swashplate pump allows for fluid flow into and out of at least one reservoir.

The multiport pump wherein the at least one reservoir is vented, sealed, pressure compensated, preloaded and/or expandable.

The multiport pumps have at least three ports that open and close ensuring balanced fluid flow is maintained along a flow path caused by pumping of the fluid with force and direction required to move, control, and/or maintain position of one or more moving device(s) in a precise and controlled fashion determined by a user.

In another embodiment, the fluid is delivered to at least one port and fluid flow continues toward and into moving device(s) that receive fluid along a fluid flow path from the pump and wherein the fluid flow path from moving device(s) can be blocked, redirected, or continually flow into one or more pumps and wherein the pumps contain components that control fluid flow returning from the moving device(s) back into the pumps, thereby completing the fluid flow path and accomplishing an ability to control intermittent or continuous movement of the moving devices.

In addition, the pump also includes a pressure compensator tank that is operationally connected to a pump inlet port of said pump through an optional fluid flow filter and wherein said compensator tank is a portion of a variable fluid reservoir.

In all embodiments, the multiport pumps can function as a motor.

The fluid reservoir includes at least one compensator tank and a port to ambient pressure and an optional reservoir pressure measuring device that measures ambient pressure and ensures an ability for the system to operate even in the presence of unbalanced flow to and from moving device(s) and allows for thermal expansion or compression within the pump and the fluid reservoir.

Here the user utilizes a controller to increase volume, change direction, and/or increase static or dynamic pressure within the fluid along a fluid flow path.

In another embodiment the fluid within the fluid reservoir is controlled by a controller.

Here the fluid reaches an upper bi-directional port of moving device(s) from the pump and is delivered to the moving device(s) and returns from the moving device(s) into a lower bi-directional port and back into the pump.

In yet another embodiment one or more moving devices are selected from the group consisting of; mechanical devices, electro-mechanical devices, electro-hydraulic devices, and actuators.

Here one or more moving devices are valves, gate valves, ball valves, seat valves, flapper valves, rotary valves, sleeve valves, packers, gears, sub-assemblies, hydraulic cylinders, hydraulic rotary actuators, bladders, accumulators, and reservoirs.

The valves are selected from the group consisting of: shuttle valves, inverted shuttle valves, inverse shuttle valves, detented shuttle valves, inverted detented shuttle valves, check valves, pilot check valves, solenoid valves, servo valves, ball valves, and gate valves.

These valves are provided in parallel, in series, or in any combination of parallel and series throughout a system with fluid provided by one or more multiport pumps so that the system is operational in that fluid can travel in either a unidirectional and/or bi-directional flow path through said system and so that fluid from said pumps powers devices that operate in either a singular or bi-directional fashion.

The pumps of the present disclosure can move a prime mover by using energy to move fluid in a flow path.

The pumps maintain pressure required to lock a position of moving devices and maintains pressure utilizing one or more check valves.

The pumps of the present disclosure do not maintain pressure when the system is not receiving energy intentionally or unintentionally so that one or more pumps are no longer functioning in a forward direction but can function in a reverse direction such that pressure on moving devices is released and reduced to greater than or equal to zero such that the moving devices can reach and reside in any desired static position.

The pumps can extract energy from a flow path and provide said energy to an external energy sink. These pumps can also function as flow measuring devices.

Most specifically, in a more precise embodiment, the present disclosure is a multiport pump that can direct fluid to ensure actuating and moving one or more devices in either a single or bi-directional direction using one or more pumps, the pumps having at least three ports that maintain pressure to pump fluid in either a clockwise or counterclockwise direction. Fluid enters and exits the pumps from either a designated clockwise (CW) or counterclockwise (CCW) outlet port thereby creating a clockwise or counterclockwise flow path without utilizing valves ensuring balanced fluid flow into and out of the pumps.

In one embodiment, the pumps can actuate and move one or more devices in either a single or bi-directional direction wherein hydraulic and/or electric power units are selected from the group consisting of pumps, motors, compressors, engines, turbines and inverters and wherein the pumps can be positive displacement multi-port pumps.

Therefore, it is now clear that at least one embodiment of the present disclosure provides for overcoming flow imbalances associated with pumps by replacing these systems with at least one or more volumetric flow balancing pumps. The current technology does not provide for pumps and pumping systems that can provide not only constant fluid volume within the pump but also constant volume of fluid flow into and out of the pump over long time durations (days, weeks, months, and years). Consequently, convention hydraulic systems for moving devices are very inefficient with regard to the loss of energy due to, among other issuers, requiring flow back through conventional flow regulators.

The flow balancing pumps and system ensure that the exact volume of fluid is being sent back into the pumps as designed herein as well as that coming out of the pumps.

In a sealed system, it is desirable and often necessary to ensure all flow of the hydraulic fluid is directed to the device to be moved and that the fluid and fluid flow remains balanced and utilizes a variable reservoir for thermal expansion or slight perturbations. Therefore, much less energy is required to keep the system running.

More specifically, another embodiment of the system of the present disclosure describes the use of at least one pump, one or more reservoirs (comprising a compensator tank, a port allowing for operation at ambient pressure, and a pressure measuring device measuring ambient pressure) that allows for unbalanced flow to and from the pump and thermal expansion or compression. In addition, an optional feature of the compensator tank that enables the system to operate at other than ambient pressure as well as another optional device that is a pressure sensor to monitor and control the fluid pressure being delivered to the mechanical (user) device(s) and optional accumulator to temporarily store and release energy (often in the form of pressurized fluid) to the device(s). The pump in this case has a fluid leak path (safety valve) that returns the fluid pressure back to its original starting pressure if and when it is required. It should be recognized that this operating system can be operated in the reverse direction and utilized as an energy source instead of as a pump, which may have an energy storage component. The determination of the utility will be dependent upon the utility requirement of the overall system. described herein.

Most specifically, in a more precise embodiment, the present invention is a multiport pump for actuating and moving one or more devices bi-directionally using at least one hydraulic and/or electrical powered multiport pumps, the pumps having at least one inlet, at least one outlet port, and at least one reservoir port for maintaining pressure to pump fluid in either a clockwise or counterclockwise direction into and out of a reservoir such that the fluid exits the pump from either a clockwise (CW) or counterclockwise (CCW) outlet port thereby creating a clockwise or counterclockwise flow path through one or more optional fluid flow filters. ensuring fluid continues along the flow path with force and direction required to move the moving device(s) in a fashion determined by the user; and wherein fluid is delivered to at least one port within the moving device(s) and fluid along the flow path from the moving device(s) is blocked, redirected, or continues to flow thereby completing the flow path and accomplishing the ability to control intermittent or continuous movement within the moving devices.

It is critical that the system allows for fluid flow along said flow path continues flowing into and out of these pumps thereby keeping one or more pump seals and associated ports filled with fluid, thereby reducing or eliminating hydraulic lock, seizure, and cavitation.

The system also includes a pressure compensator tank that is operationally connected to the multiport pump inlet port of the pump through an optional fluid flow filter and wherein the compensator tank is a portion of a fluid reservoir. The one or more multiport pumps can function as a motor.

The fluid reservoir includes at least one compensator tank and a port to ambient pressure and an optional reservoir pressure measuring device that measures ambient pressure and ensures the ability for the pump to operate even in the presence of unbalanced flow to and from the moving device(s) and allows for thermal expansion or compression within the pump.

The pump system allows for a user to utilize a controller to increase volume, change direction, and/or increase static or dynamic pressure within the fluid along the flow path. Additionally, the fluid within the fluid reservoir can be controlled by a controller.

The multiport pumps may be powered by hydraulic/electric power units selected from the group consisting of pumps, motors, compressors and inverters.

The system has fluid that reaches an upper bi-directional port of moving device(s) and is delivered to those device(s) and returns from those device(s) into a lower bi-directional port.

The system may also contain devices which equalize the flow in and out of the power unit to accommodate various devices connected to the power unit. The one or more devices are selected from the group consisting of; valves, check valves, pilot operated check valves, shuttle valves, detented shuttle valves, inverted shuttle valves, gates, and solenoids.

The system may also contain at least two sets of pilot operated check valves. The system may also contain one or more valves that are a detented shuttle valve with at least three ports. In addition, or separately, the system may also contain one or more valves that are an inverted shuttle valve with at least three ports.

The system may have one or more optional fluid flow filters and one or more optional pressure measuring devices.

The one or more devices are selected from the group consisting of; mechanical devices, electro-mechanical devices and electro-hydraulic devices.

These devices can be one or more of the following; valves, gate valves, ball valves, seat valves, flapper valves, rotary valves, sleeve valves, packers, gears, sub-assemblies, hydraulic cylinders, hydraulic rotary actuators, bladders, accumulators, and reservoirs.

For these devices the valves are selected from the group consisting of: shuttle valves, inverted shuttle valves, inverse shuttle valves, detented shuttle valves, inverted detented shuttle valves, check valves, pilot check valves, solenoid valves, servo valves, ball valves, and gate valves.

The present disclosure also includes one or more methods for using multiport pumps to move mechanical user devices comprising, for example;

using one or more pumps (or motors) for providing bi-directional flow of fluid along a flow path having a single inlet port for flow in either the CW or CCW direction so that fluid reaches an upper bi-directional port of a mechanical user device and is delivered to the mechanical user device and returns from the mechanical user device into a lower bi-directional port, wherein the flow path allows fluid to exit the pump(s) from either through a CW or CCW outlet port continuing through a first CW optional fluid flow filter and a CW operating check valve wherein the check valve is ensuring the fluid continues flowing in either the CW or CCW direction and wherein the fluid is delivered through a second optional fluid flow filter to the upper bi-directional port. The fluid flowing within the flow path flow continues flowing and utilizing the pump and specifically continually flows to a pump inlet port and motor seal of the pump, thereby ensuring the pump remains operational during operation of the system.

Here also, the pressure compensator tank is operationally connected to the pump inlet port through another optional fluid flow filter and the compensator is a portion of a reservoir.

The reservoir comprises a compensator tank, a port to ambient pressure and an optional reservoir pressure measuring device for measuring ambient pressure that ensures the ability for a sealed system to operate in the presence of unbalanced flow to and from the mechanical user devices.

The afore-described system allows for thermal expansion or compression within a sealed system.

The mechanical user devices are selected from at least the group consisting of; mechanical devices, electro-mechanical devices and electro-hydraulic devices.

An additional method describes using multiport pumps to move devices comprising; utilizing by controlling fluid flow along a flow path having one or more motors powered using hydraulics and/or electricity together with an optional check valve arrangement which allows for said system to be run in a reverse direction wherein;

the motors are also utilized as energy generators and wherein the motors drive fluid in a CW direction so that the fluid flow reaches an upper bi-directional port to deliver fluid flow to a balanced hydraulic actuator such as a hydraulic cylinder with piston faces of equal surface areas and wherein the fluid flow returns from one or more balanced hydraulic actuators to a lower bi-directional port;

wherein the fluid flow is next delivered through a second optional fluid flow filter through an upper bi-directional port. This method provides two distinct return flow paths, a first return fluid flow path that returns fluid from a balanced hydraulic actuator to a lower bi-directional port through a third optional fluid flow filter to the motors into a CCW outlet port and through a first CCW optional fluid flow filter so that fluid flows through the motors with an exactly equal flow entering a CCW outlet port as is exiting a CW outlet port ensuring the fluid of the fluid flow is provided to reduce or eliminate motor cavitation.

This allows returning fluid flow from a lower bi-directional port through a third optional fluid flow filter for flowing into and out of the multiport pumps such that the second flow path is completed as fluid flow continues to the motors and pressure from the fluid seals motor seal ports, thereby maintaining fluid pressure across the motor seal ports.

The pressure from the fluid is static pressure providing pressure equalization during operation of the multiport pumps so that internal motor shaft seals will not fail.

The motor shaft seals are seals that exist around a shaft of a motor to ensure that when the shaft rotates, excessive heat due to mechanical friction is not produced by using the fluid as a heat transfer medium through the shaft seals.

The pumping system described includes valves selected from the group consisting of; shuttle valves, inverted shuttle valves, inverse shuttle valves, detented shuttle valves, inverted detented shuttle valves, inverse detented shuttle valves, check valves and pilot check valves.

Also, these valves are provided in parallel, in series, or in any combination of parallel and series throughout the system as required so that the system is operational and so that the fluid can travel in either a unidirectional and/or bi-directional flow path through the multiport pumps and so that the fluid powers devices that can operate in a singular or bi-directional fashion.

In further embodiments it is also possible to provide compressed fluid energy storage systems using what has been described. Such systems may be implemented using a hydraulic drive system comprised of hydraulic components including components with multiport hydraulic pumps used to drive working pistons. Therefore, there is also a need for systems and methods to obtain a high efficiency output of a compressed fluid energy storage system, or other systems used to compress and/or expand gas, including controls and operating modes that leverage bi-directional movement of devices during operation of such systems.

The pumps provided utilize energy to move fluid in a flow path, the pump extracts energy from a flow path to an external energy sink. The pumps may act as flow measuring devices by measuring the rotations of the pump shaft so that a correspondence between the number of rotations of the shaft and the flow can be established.

In addition the pump includes a barrel in which a piston resides and can operate along a longitudinal and/or rotational axis of the barrel such that when the piston is in an extended position at one end of a section of the barrel, the barrel includes a larger inside diameter portion than any other section of the barrel in order to provide a debris trap such that debris caused during pump operation is removed from working fluid that envelops the pump.

In addition, the multiport pump pumps fluid in order to achieve multifunctional flow along multifunctional flow paths so that the fluid can be routed to perform multiple functions within a single operating device.

Another devices includes at least one bi-directional hydraulic power unit (HPU) unit together with the HPU are combined to create a pump for fluid that flows along a fluid flow path wherein the HPU and the multiport pump together provide an integrated flow balancing device that operates as a pump or a motor depending on direction of flow into and out of the integrated balancing device.

Operation of some of the pumps and associated pumping systems are included as a portion of the present invention and disclosure are detailed in the following embodiments.

DETAILED DESCRIPTION

Figure 1A:
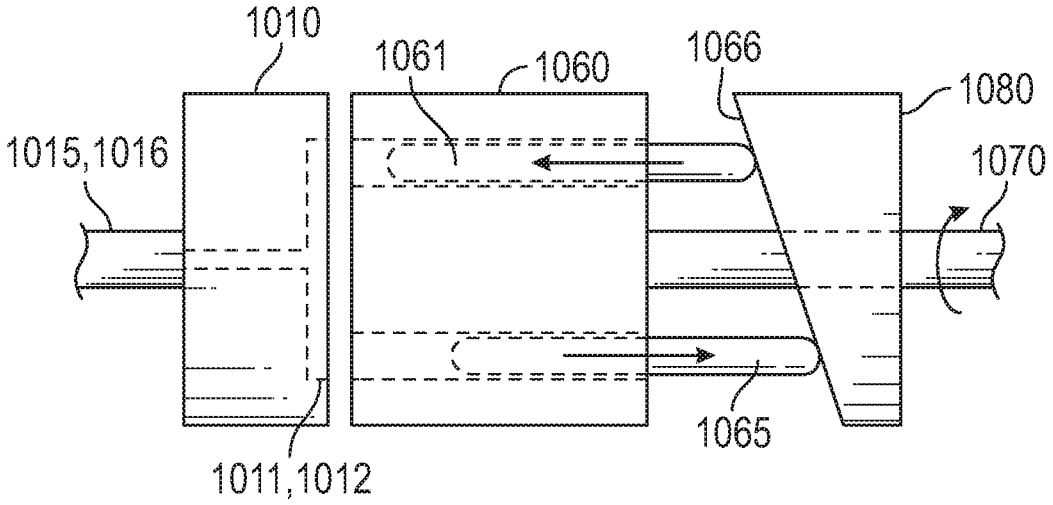
FIG. 1A (Prior Art)
FIG. 1A is a cross sectional side view of a known design for a swashplate pump.
Figure 1B:
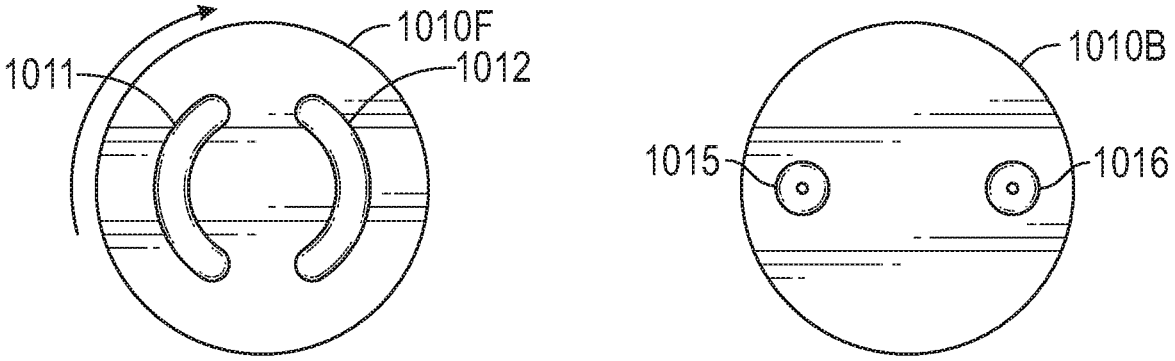
FIG. 1B (Prior Art)
FIG. 1B is a front and back view of a current valve plate design for the same swashplate pump shown in FIG. 1A.

FIGS. 1A and 1B represent known swashplate pump designs with valve plates (prior art) representative of state-of-the-art devices. These pumps were initially designed to simplify other older pump designs in that these pumps have no moving valves, no cam shafts, no crankshafts, and no connecting rods, thereby minimizing the number of parts that can fail due to wear or improper use of the pump. This compact design also leads to better efficiency and lower costs during the lifetime of the pump. In FIG. 1A, valve plate (1010) directs the fluid to the user device through ports. These ports include a cw port (1015) which is connected to a valve plate kidney (1011) and ccw port (1016) that connects with a valve plate kidney (1012). Rotating cylinder bore barrel (1060) includes cylinder bores for each piston. Piston (1061) shown in a top dead center position (TDC) and piston (1065) shown in the bottom dead center (BDC) position are illustrative of the entire piston set residing in the rotating cylinder bore barrel (1060). This barrel (1060) is a rotated with drive shaft (1070) in either a cw or ccw direction at a speed appropriate for delivering fluid and a torque appropriate for delivering the desired pressure. Swashplate (1080) is stationary while the piston angled contact surface (1066) functions as the dwell cam which actuates the entire piston set that allows for translating the rotary drive shaft into an axial piston movement in the rotating cylinder bore barrel (1060).

The valve plate, shown in FIG. 1B includes both a front and back view (1010 F—front view and 1010B—back view) of a state-of-the-art design. This valve plate functions by directing flow between the cw valve plate kidney (1011) and the ccw valve plate kidney (1012). The cw valve plate kidney (1011) is connected through the plate to the cw port (1015). The ccw valve plate kidney (1012) is connected through the plate to the ccw port (1016).

In operation of this specific swashplate pump (which is illustrated using only two pistons—1061 and 1065, representative of swashplate pumps with 2 or more pistons), starting from the illustrated position of the rotating barrel (1060) with pistons, piston (1061) is located at TDC and is driven clockwise engaging with counterclockwise valve plate kidney (1012). Next, as the barrel (1060) rotates clockwise, the piston (1061) moves toward a BDC position during a 180 degree rotation, ending at a BDC position. During that rotation, the piston (1061) moves away from the valve plate thereby pulling fluid into the piston cylinder resulting in pulling fluid from the user device connected to the ccw—counterclockwise—port (1016).

Simultaneously, starting from the illustrated position of the rotating barrel (1060) with pistons, piston (1065) which is initially located at a BDC position and is driven clockwise engaging with clockwise valve plate kidney (1011). Next, as the barrel (1060) rotates clockwise, the piston (1065) moves toward a TDC position during a 180 degree rotation, ending at a TDC position. During that rotation, the piston (1065) moves toward the valve plate thereby displacing fluid from the piston cylinder resulting in displacing fluid toward the user device connected to cw—clockwise—port (1015).

The pistons as illustrated in the TDC and BDC positions described above allow no flow to move into or out of the rotating cylinder bore barrel (1060). In other words, any piston which passes across these regions causes the valve cylinder bores in the barrel to close.

Figure 1C:
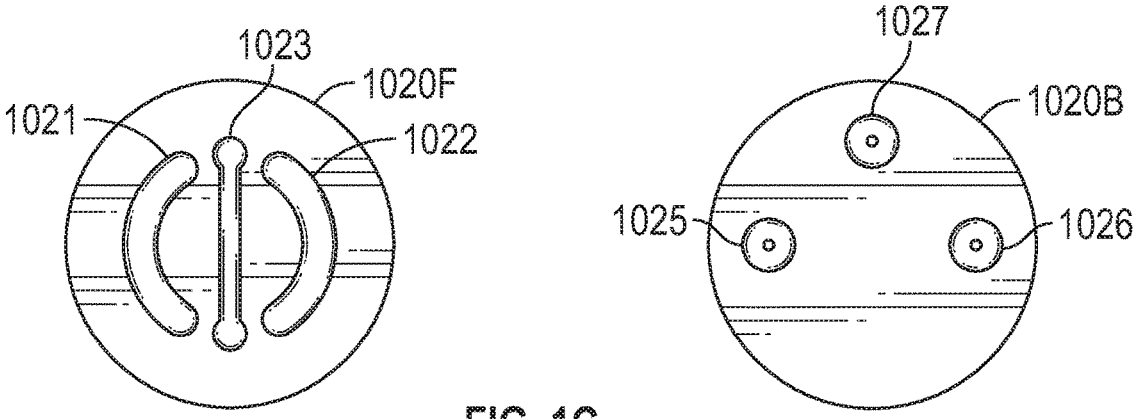
FIG. 1C is front and back view of a three (3)-port swashplate pump as described in this disclosure.
Figure 1D:
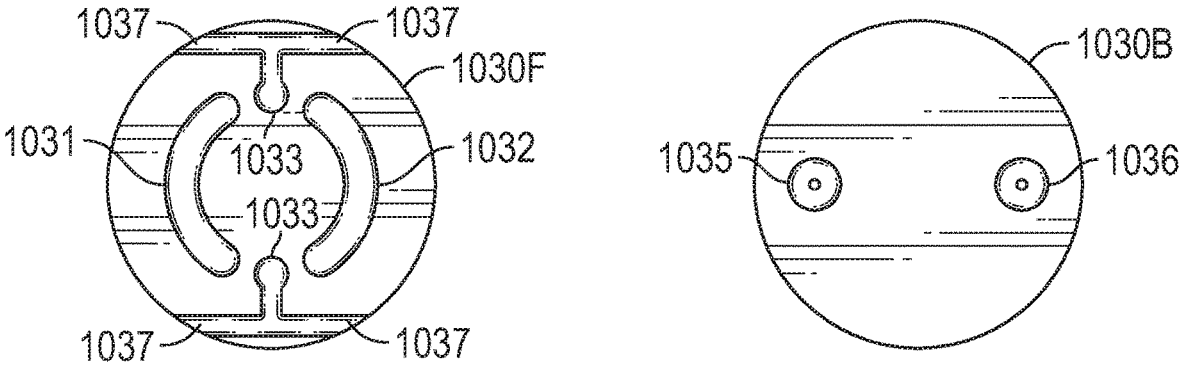
FIG. 1D is a format and back view of a three (3)-port valve plate directly vented to and/or for immersion into a reservoir as described in the present disclosure.

For the present disclosure, the valve plate design for the multiport swashplate pump has been changed as shown in FIGS. 1C, 1D, 1E, and 1F. Specifically, FIG. 1C and FIG. 1D illustrate 3-port valve configurations. FIG. 1C indicates 1020F which is the front view of a 3-port valve plate and 1020B is the back view the same 3-port valve plate. The cw kidney (1021) and ccw kidney (1022) as well as the cw port (1025) and ccw port (1026) have the same functionality as those shown above as (1011, 1012—the kidneys and 1015 and 1016—the ports) shown in FIG. 1B. The purpose of the third valve port which is a third center kidney port (1023) is to momentarily and remotely connect each cylinder to the reservoir through a reservoir port (1027) during operation of the pump at either TDC or BDC. This is to ensure balanced volume within the pump as well as balanced volumetric flow to the user device regardless of imbalances in the flow requirements to and from the user device. If there is more fluid returning from the user device than is being sent to the user device, the excess fluid is returned to the reservoir as the pistons pass over third center reservoir kidney port (1023). Conversely if there is less fluid returning from the user device than is being sent to the user device, the deficit fluid will be supplied by the reservoir to the user device through the third center reservoir kidney (1023).

FIG. 1D indicates 1030F which is the front view of a 3-port valve plate and 1030B is the back view the same 3-port valve plate. The cw kidney (1031) and ccw kidney (1032) as well as the cw port (1035) and ccw port (1036) have the same functionality as those shown above as (1011, 1012—the kidneys and 1015 and 1016—the ports) shown in FIG. 1B. The purpose of the third valve port which is a third center kidney immersion port (1033) is to momentarily and directly connect each cylinder to the reservoir through a reservoir port (1037) designed for direct immersion of the pump in the reservoir during operation of the pump at either TDC or BDC. This is still to ensure balanced volume within the pump as well as balanced volumetric flow to the user device regardless of imbalances in the flow requirements to and from the user device. If there is more fluid returning from the user device than is being sent to the user device, the excess fluid is returned to the reservoir as the pistons pass over third center immersion kidney port (1033). Conversely if there is less fluid returning from the user device than is being sent to the user device, the deficit fluid will be supplied by the reservoir to the user device through the third center immersion kidney port (1033).

Figure 1E:
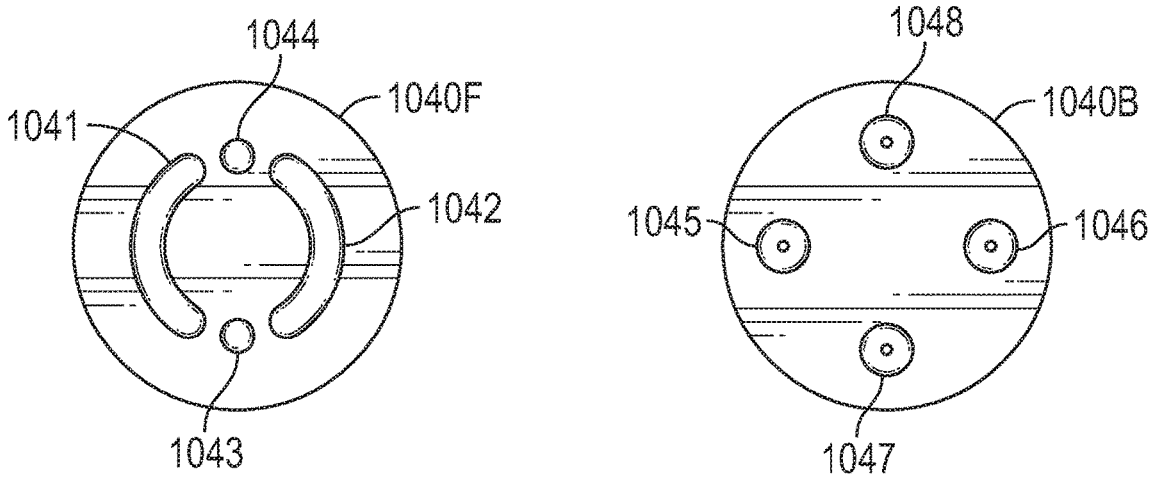
FIG. 1E is front and back view of a four (4)-port swashplate pump as described in the present disclosure.
Figure 1F:
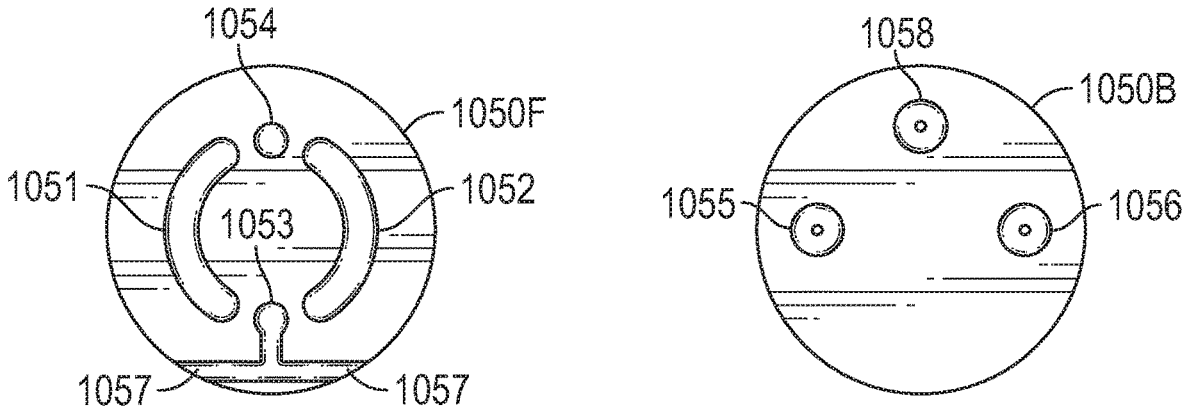
FIG. 1F is a front and back view of a four (4)-port valve plate directly vented to and/or for immersion into a reservoir as described in the present disclosure

Specifically, FIG. 1E and FIG. 1F illustrate 4-port valve configurations. FIG. 1E indicates 1040F which is the front view of a 4-port valve plate and 1040B is the back view the same 4-port valve plate. The cw kidney (1041) and ccw kidney (1042) as well as the cw port (1045) and ccw port (1046) have the same functionality as those shown above as (1011, 1012—the kidneys and 1015 and 1016—the ports) shown in FIG. 1B. The third port is the reservoir kidney port (1043) connected to the reservoir port (1047) located at BDC which serves the same function as (1023) above but only in the BDC position. The purpose of the fourth valve sensor kidney (1044) is to momentarily and remotely connected each cylinder through a sensor port (1048) during operation of the pump at TDC so that the sensor kidney (1044) and sensor port (1048) are both connected to the highest pressure that occurs within the pump. The functionality of the fourth valve kidney (1044) and the sensor port (1048) is to monitor and control operation of the one or more pumps and user devices that comprise a pumping system.

Specifically, FIG. 1E and FIG. 1F illustrate 4-port valve configurations. FIG. 1F indicates 1050F which is the front view of a 4-port valve plate and 1050B is the back view the same 4-port valve plate. The cw kidney (1051) and ccw kidney (1052) as well as the cw port (1055) and ccw port (1056) have the same functionality as those shown above as (1011, 1012—the kidneys and 1015 and 1016—the ports) shown in FIG. 1B. The third port is the reservoir kidney immersion port (1053) connected to the reservoir immersion port (1057) located at BDC so that each piston is momentarily and directly connected to the reservoir through the reservoir port (1057) designed for direct immersion of the pump in the reservoir during operation of the pump at BDC. This is still to ensure balanced volume within the pump as well as balanced volumetric flow to the user device regardless of imbalances in the flow requirements to and from the user device. If there is more fluid returning from the user device than is being sent to the user device, the excess fluid is returned to the reservoir as the pistons pass over the third center immersion kidney port (1053). Conversely if there is less fluid returning from the user device than is being sent to the user device, the deficit fluid will be supplied by the reservoir to the user device through the third center immersion kidney port (1053). The purpose of the fourth valve sensor kidney (1054) is to momentarily and remotely connect each cylinder through a sensor port (1058) during operation of the pump at TDC so that the sensor kidney (1054) and sensor port (1058) are both connected to the highest pressure that occurs within the pump. The functionality of the fourth valve kidney (1054) and the sensor port (1058) is to monitor and control operation of the one or more pumps and user devices that comprise a pumping system.

The devices and systems described herein can be implemented in a wide range of sizes and operating configurations. In other words, the physics and fluid mechanics of the system do not depend on a particular system size. The estimated power range results from a system design constrained to use current commercially available components, manufacturing processes, and transportation processes. Larger and/or smaller system power may be preferred if the design uses a greater fraction of custom, purpose-designed components. Moreover, system power also depends on the end-use of the system. In other words, the size of the system may be affected by whether the system is implemented in the compressor/expander mode or whether the system is being used to deliver only compression or only expansion via one or more pumps.

Devices and systems used to compress and/or expand a gas can be configured to operate in a compression mode to compress fluids up to at least 10,000 psi. Devices and systems used to compress and/or expand a gas can be configured to operate in an expansion mode to expand a gas such that the compressed gas from the compressed gas storage chamber has a pressure ratio to that of the expanded gas of 250:1. In some embodiments, a compression/expansion device is configured to expand a gas through two or three stages of expansion.

Devices and systems used to compress and/or expand a fluid including air, and gas, and/or to pressurize and/or pump a fluid, such as water, can release and/or absorb heat during, for example, a compression or expansion cycle. In some embodiments, one or more pneumatically or electrically actuated valves can include a heat capacitor for transferring heat to and/or from the gas as it is being compressed/expanded. In some embodiments, the heat transfer element can be a thermal capacitor that absorbs and holds heat released from a gas that is being compressed, and then releases the heat to a gas or other fluid at a later time. In some embodiments, the heat transfer element can be a heat transferring device that absorbs heat from a liquid that is being compressed, and then facilitates the transfer of the heat outside of the device.

In another example, heat can be transferred from and/or to gas that is compressed and/or expanded by adding and/or removing liquid (e.g., water) to/from within a pneumatic cylinder. A gas/liquid or gas/heat element interface may move and/or change shape during a compression and/or expansion process in a pneumatic cylinder. This movement and/or shape change may provide a compressor/expander device with a heat transfer surface that can accommodate the changing shape of the internal areas of a pneumatic cylinder in which compression and/or expansion occurs. This movement and/or shape change may provide a compressor/expander device with a heat transfer surface that optimizes its heat transfer performance with respect to the current conditions within the pneumatic cylinder, for example, with respect to gas density, gas temperature, and/or relative temperature of gas and liquid, among others. In some embodiments, the liquid may allow the volume of gas remaining in a pneumatic cylinder after compression to be nearly eliminated or completely eliminated (i.e., zero clearance volume).

A liquid (such as water or oil or other hydraulic fluids) can have a relatively high thermal capacity as compared to a gas (such as air) such that a transfer of an amount of heat energy from the gas to the liquid avoids a significant increase in the temperature of the gas, but only incurs a modest increase in the temperature of the liquid. This allows buffering of the system from substantial temperature changes. In other words, this relationship creates a system that is resistant to substantial temperature changes. Heat that is transferred between the gas and liquid, or components of the vessel itself, may be moved from or to (for example) a pneumatic cylinder through one or more processes. In some embodiments, heat can be moved in or out of the cylinder using mass transfer of the compression liquid itself. In other embodiments, heat can be moved in or out of the cylinder using heat exchange methods that transfer heat in or out of the compression liquid without removing the compression liquid from the cylinder. Such heat exchangers can be in thermal contact with the compression liquid, components of the cylinder, a heat transfer element, or any combination thereof. Furthermore, heat exchangers may also use mass transfer to move heat in or out of the cylinder. Thus, the liquid within a cylinder can be used to transfer heat from gas that is compressed or compressing (or to gas that is expanded or expanding) and can also act in combination with a heat exchanger to transfer heat to an external environment (or from an external environment). Any suitable mechanism for transferring heat out of the device during compression and/or into the device during expansion may be incorporated into the system.

In some embodiments, a hydraulic actuator includes a hydraulic ram (a component familiar to those skilled in the art of hydraulic actuation) that connects to a pneumatic piston using a piston rod. Piston motion results when a hydraulic pump urges hydraulic fluid into and/or out of a chamber or chambers of the hydraulic ram. Component sizes depend on the power desired for the complete system, on fluid pressures, and on the hydraulic fluid pressures. The fluid pressures in the pneumatic portion of the system, and hydraulic fluid pressure in the hydraulic pump/motor are considered simultaneously in order to configure the relative sizes of hydraulic ram pistons and the pneumatic cylinder pistons. In general, the ratio of the cross-sectional area of the hydraulic ram piston, to the cross-sectional area of the pneumatic cylinder piston must be in proportion to the ratio of the hydraulic pump/motor operating pressure, to the pneumatic cylinder operating pressure. For example, a hydraulic pump/motor may have a maximum operating pressure of 10,000 psi, if the maximum desired fluid pressure is 2500 psi, then the ratio between hydraulic ram piston cross sectional area to the pneumatic cylinder piston may be no less than 100 divided by 400, and in fact should be greater than this ratio figure in order to overcome machine aspects such as component friction and the like. In addition, the ratio of hydraulic ram piston cross section area to pneumatic piston cross section area can be modified during system operation configuring a hydraulic actuation system with more than one hydraulic ram, a concept which is described in more detail below.

In the present disclosure, the system operation may be controlled by a hydraulic controller and/or electric controller. The controller coordinates: valve actuation, pump/motor operation, fluid direction, and compression/expansion operation. During expansion operation, the controller determines the volume of fluid to admit from a reservoir into the system. By way of example, the controller may collect and evaluate system status information such as the temperatures and pressures of: the fluid storage chambers, cylinders, the fluid source and determine a preferred volume of fluid to admit from the reservoir into or out of the system. The controller may admit a fluid volume calculated to expand such that the fluid achieves a pressure roughly equivalent to the pressure of the fluid source. It is understood that it may be desirable to expand the fluid to pressures that may be greater than, or less than the pressure of the fluid source. The controllers may be used with any of many control paradigms to define overall machine operation such as: a time-based schedule for fluid volume, a time-based schedule for fluid pressure, a time-based schedule for fluid temperature, a parametrically described and controlled position evolution, pressure evolution, temperature evolution, or power consumption/generation. Those skilled in the art of controller design will understand that the possible control algorithms are virtually unlimited.

The present disclosure is specific to the use of one or more multiport pumps to insure a constant volume of fluid remains within the pumps. One such pump is an axial piston type hydraulic pump, and more specifically a hydraulic pump wherein a plurality of pistons are arranged within a liquid tight slidable engagement within cylinders driven for endwise reciprocation by a swash plate. This pump type is known as a "swashplate pump" described in full detail in U.S. Pat. No. 4,007,663. The present disclosure provides a valve plate design for these swashplate pumps that also enables fluid volume to remain constant or nearly constant during operation of the apparatus and system described herein. When needed, fluid volume is adjusted by either adding or removing fluid from the apparatus/system/pump by use of the previously described reservoir. By designing the pump with a multi-port valve plate design, it is possible to continuously access the reservoir as needed. This results in reducing the complexity and cost associated with providing the apparatus and system with the required fluid flow and fluid flow path without the need for an inverse shuttle valve (3-port valve plate design) and in some cases without the need for both a detented shuttle valve and an inverse shuttle valve (4-port valve plate design).

While various embodiments of the invention have been described above, it should be understood that they have been presented by way of example only, and not limitation. Where methods and steps described above indicate certain events occurring in certain order, those of ordinary skill in the art having the benefit of this disclosure would recognize that the ordering of certain steps may be modified and that such modifications are in accordance with the variations of the invention. Additionally, certain of the steps may be performed concurrently in a parallel process when possible, as well as performed sequentially as described above. Additionally, certain steps may be partially completed before proceeding to subsequent steps. The embodiments have been particularly shown and described, but it will be understood that various changes in form and details may be made.

Although various embodiments have been described as having particular features and/or combinations of components, other embodiments are possible having any combination or sub-combination of any features and/or components from any of the embodiments described herein.

What is claimed is:

1. At least one multiport pump that pumps fluid in either a single or bi-directional direction having multiple ports comprising; at least one inlet port, at least one outlet port, and at least one equilibrator port connected to a fluid reservoir wherein said equilibrator port equilibrates inlet and outlet flow such that a combination of said inlet port and said equilibrator port provide just enough fluid volume to fill one or more cavities of said at least one multiport pump so that fluid escapes through said outlet port to ensure overfill of said ports is prevented and so that a balanced equilibrium constant volume of fluid is maintained and resides within said at least one multiport pump during operation, wherein said at least one multiport pump withdraws and/or sends fluid into and out of said fluid reservoir to maintain a constant volume of fluid that reduces cavitation and hydraulic fluid lock and also provides and allows a balanced constant continuous fluid flow along a fluid flow path that contains fluid that flows in either a clockwise or counter-clockwise direction into and out of said fluid reservoir that also acts as a constant volume compensator, such that an incremental volume of fluid is added or removed to maintain equal symmetric inflow and outflow of fluid into and out of said at least one multiport pump and wherein said fluid reservoir is vented, sealed, pressure compensated, preloaded and/or expandable thereby completing said fluid flow path and accomplishing an ability to control intermittent and/or continuous movement of moving devices.

2. The at least one multiport pump of claim 1, wherein said cavitation is eliminated unless an absence of enough fluid to completely fill one or more pump and/or port cavities enters or exits said at least one multiport pump at any time during start-up, operation, or shut down and wherein hydraulic fluid lock is eliminated unless an excess of fluid overfills one or more pump and/or port cavities as fluid enters or exits said at least one multiport pump at any time during start-up, operation or shut down.

3. The at least one multiport pump of claim 1, wherein one or more multiport pumps and are selected from the group consisting of;

swashplate pumps, reciprocating pumps, scroll pumps, piston pumps, diaphragm pumps, injection pumps, centrifugal pumps, gear pumps, and metering pumps and wherein said fluid is air, a gas, a liquid, or any combination of air, gas, and liquid.

4. The at least one multiport pump of claim 1, wherein a constant volumetric balance of both said volume of fluid and said fluid flow occurs simultaneously during operation of said at least one multiport pump and wherein a fluid system operated by said at least one multiport pump may be a fluid system that is open to atmosphere or that is closed to atmosphere and wherein said at least one multiport pump can be primed with fluid during start-up and can be drained of fluid during shutdown and wherein said at least one multiport pump can operate in either a clockwise or counterclockwise direction so that when pressure into said at least one multiport pump is increased and then released no pressure is retained within said at least one multiport pump and wherein accordingly said at least one multiport pump can operate as both an hydraulic pump and as an hydraulic motor depending on which direction said fluid flows along said fluid path.

5. The at least one multiport pump of claim 1, wherein said at least one multiport is at least one multiport swashplate pump that includes a multi-port valve plate such that fluid flow into and out of said multiport swashplate pump is either unidirectional or bidirectional and wherein said multiport valve plate includes at least three ports.

6. The at least one multiport swashplate pump of claim 5, wherein an at least three-port valve plate ensures a constant volumetric balanced fluid flow exists and is maintained within said at least one multiport pump in that said fluid flow volume remains constant throughout operation of said at least one multiport swashplate pump as said at least one multiport swashplate pump is utilized to operate and control movement of a hydraulic apparatus.

7. The at least one multiport swashplate pump of claim 6, wherein said at least three-port valve plate includes at least three corresponding valves and wherein at least one port is designated for counterclockwise flow, at least one port is designated for clockwise flow and at least one port is designated as a reservoir port, wherein said reservoir port allows for constant volumetric fluid flow balancing by utilizing said reservoir to either add or remove a volume of fluid as needed during operation of said at least one multiport swashplate pump.

8. The at least one multiport swashplate pump of claim 5, wherein said at least one multiport swashplate pump includes an at least four-port valve plate and includes at least four corresponding valves wherein at least one port is designated for counterclockwise flow, at least one port is designated for clockwise flow, at least one port is designated as a reservoir port, and at least one port is designated as a sensor port.

9. The at least one multiport swashplate pump of claim 8, wherein said sensor port provides a portion of said at least one multiport swashplate pump for including a sensor within or attached to said port that measures volume, pressure, and temperature of both fluid and fluid flow along a fluid flow path.

10. The at least one multiport swashplate pump of claim 9, wherein said sensor port is a monitor port, wherein said monitor port monitors fluid, fluid volume, and fluid flow and can also provide hydraulic actuators.

11. The at least one multiport pump of claim 1, wherein when said at least one multiport pump moves in a clockwise direction, it delivers fluid to a clockwise port and withdraws fluid from a counterclockwise port.

12. The at least one multiport pump of claim 1, wherein when said at least one multiport pump moves in counterclockwise direction, it delivers fluid to a counterclockwise port and withdraws fluid from a clockwise port.

13. The at least one multiport pump of claim 5, wherein said at least one multiport pump and/or said three-port valve plate that includes a swashplate pump are fully submersed.

14. The at least one multiport pump of claim 5, wherein said at least one multiport pump and/or said at least four-port valve plate that includes said swashplate pump are fully submersed.

15. The at least one multiport pump of claim 5, wherein said at least one multiport pump and/or said swashplate pump provides and allows for fluid flow into and out of at least one reservoir.

16. At least one multiport pump that pumps fluid in either a single or bi-directional direction having multiple ports comprising; at least one inlet port, at least one outlet port, and at least one equilibrator port connected to a fluid reservoir wherein said equilibrator port equilibrates inlet and outlet flow such that a combination of said inlet port and said equilibrator port provide just enough fluid volume to fill one or more cavities of said at least one multiport pump without an overfill of fluid that escapes through said outlet port so that a rate of change of volume of fluid is constant and prohibits cavitation and hydraulic fluid lock and also provides and allows a balanced constant continuous fluid flow along a flow path in either a clockwise or counterclockwise direction into and out of said fluid reservoir such that an incremental volume of fluid is added or removed to maintain equal symmetric inflow and outflow of fluid into and out of said at least one multiport pump.

17. At least one multiport pump that pumps fluid in either a single or bi-directional direction having multiple ports comprising; at least one inlet port, at least one outlet port, and at least one equilibrator port connected to a fluid reservoir wherein said equilibrator port equilibrates inlet and outlet flow such that a combination of said inlet port and said equilibrator port provide for a balanced equilibrium constant volume and/or rate of change of volume of fluid that is constant so that fluid is maintained within said at least one multiport pump during operation, wherein said at least one multiport pump withdraws and/or sends fluid into and out of said fluid reservoir to maintain a constant volume and/or rate of change of volume of fluid which is constant and reduces cavitation and hydraulic fluid lock and also provides and allows a balanced constant continuous fluid flow along a flow path in either a clockwise or counterclockwise direction into and out of said fluid reservoir such that an incremental volume of fluid is added or removed to maintain equal symmetric inflow and outflow of fluid into and out of said at least one multiport pump.

* * * * *